US006263790B1

(12) United States Patent
Wyssmann et al.

(10) Patent No.: US 6,263,790 B1
(45) Date of Patent: Jul. 24, 2001

(54) MACHINE FOR SECURITY PRINTING ON SECURITY PAPER

(75) Inventors: Hans Wyssmann, Zurich (CH); Johann Emil Eitel, Thüngen (DE); Kurt Georg Nagler, Zell (DE); Johannes Georg Schaede, Würzburg (DE)

(73) Assignee: De La Rue Giori S.A., Lausanne (CH)

( * ) Notice: Subject to any disclaimer, the term of this patent is extended or adjusted under 35 U.S.C. 154(b) by 0 days.

(21) Appl. No.: 09/332,842

(22) Filed: Jun. 14, 1999

(30) Foreign Application Priority Data

Jun. 16, 1998 (CH) ..... 1301/98

(51) Int. Cl.[7] ..... B31F 1/07
(52) U.S. Cl. ..... 101/35; 101/22
(58) Field of Search ..... 101/35, 22, 45, 101/487, 492, 33, 34, 16, 484, 483

(56) References Cited

U.S. PATENT DOCUMENTS 2,501,495 * 3/1950 Carroll et al. ..... 101/487
5,279,222 * 1/1994 Di Luco ..... 101/211
5,429,044 * 7/1995 Giori et al. ..... 101/33
5,618,378 * 4/1997 Cahill ..... 156/552
5,627,356 * 5/1997 Takemoto et al. ..... 235/381
5,717,776 * 2/1998 Watanabe ..... 382/116
5,768,143 * 6/1998 Fujimoto ..... 364/479.05

* cited by examiner

*Primary Examiner*—John S. Hilten
*Assistant Examiner*—Anthony H. Nguyen
(74) *Attorney, Agent, or Firm*—Bugnion S.A.; John Moetteli

(57) ABSTRACT

The machine further comprises a paper sheet feed device, a device for transporting the paper and a unit for applying security images (7) supported by at least one ribbon (8, 8a). The ribbon is brought into contact with the paper (1) so that the images (7) are applied at determined points on the paper. The application unit comprises an applicator cylinder (5) fitted with pads (52) in register with determined points on the sheets (1) and cooperates with a press cylinder (4), between which cylinders the paper (1) passes. The ribbon (8, 8a) is mounted between two reels (B1, B2) for paying out the ribbon and (25) for winding up the ribbon. The machine is equipped with a device (13) for preheating the ribbon (8, 8a) upstream of the applicator cylinder (5) so as to preheat the images (7) which will be applied to the sheet of paper (1) by simple contact of said pads (52) with the images (7) against the press cylinder (4).

10 Claims, 3 Drawing Sheets

MACHINE FOR SECURITY PRINTING ON SECURITY PAPER

BACKGROUND OF THE INVENTION

The present invention relates to a machine for the security printing of security paper, especially banknotes, comprising a paper sheet feed device, a device for transporting the paper and a unit for applying security images supported by at least one ribbon which is brought into contact with the paper such that these images are applied at determined points on the paper corresponding to the printing on the security paper, the application unit comprising an applicator cylinder fitted with pads arranged on the periphery of the applicator cylinder in register with said determined points, cooperating with an impression cylinder, between which cylinders the paper passes, said ribbon being mounted between two reels—for paying out the ribbon, and for winding up the ribbon—the ribbon passing parallel to the path of the paper.

It is already known practice to create security zones on security paper and in particular on banknotes, by applying images in the form of a film so as to make these papers difficult to falsify, particularly to reproduce by the use of photocopiers, the reproduction quality of which is ever increasing. These images are often optically variable images comprising either a kinegram or a hologram which have the property of changing appearance depending on the angle from which they are viewed. These images may be applied either hot or cold. In the European patent application No 0 625 466 A1, the content of which is incorporated by reference, by the same applicant, there is described an apparatus that allows such images to be applied cold using a two-part adhesive, the first part of the adhesive being applied at the desired point on the notes which have been partially or completely printed on a sheet and it is dried by passing the sheet past a catalyst. Thereafter, using an applicator cylinder and a press cylinder, the images, which have the second part of the adhesive, are applied to the previously chosen points, simply by the action of pressure.

In the abovementioned machine, the ribbon travels between two cassettes along a generatrix of the applicator cylinder. The applicator cylinder is fitted with a number of pairs of these cassettes to allow several images to be applied to several points of a sheet in a single pass.

There is also another type of apparatus which comprises a unit for applying an optically variable image borne by a ribbon of which there is one for each impression column and which is paid out between a paying-out reel and a winding-up reel. The path between the two reels comprises, apart from the guiding and tensioning rolls and rollers, a cylinder which has circumferential grooves, interrupted by bridges, said ribbon passing along said grooves. The sheets to be processed pass between said cylinder and press cylinders and image transfer occurs each time a bridge runs over the press cylinder. The applicator cylinder is heated to activate the adhesive borne by the image. In order that the adhesive should be heated sufficiently to obtain the desired effect, contact between the bridge of the applicator cylinder and the images must last for a certain length of time, which means that the dimensions of the applicator cylinder and those of the press rolls must always be tailored to the size of sheet and of the security papers partially or completely printed on said sheets. The ribbon carrying the images passes continuously and in synchronism with the sheets to which the images are to be applied. This apparatus produced by the applicant is satisfactory.

However, the obligation to maintain contact between the applicator cylinder and the image to be transferred for a period of time means that each time the paper format is changed, fundamental modifications have to be made to the applicator cylinder and to the press cylinder. Furthermore, the press cylinder used to keep the sheets in contact with the applicator cylinder prior to the transferring of the image, crushes the sheet along the entire length at the two ends of the sheet in the direction of travel of the paper. Specifically, for the sheet to remain in contact with the applicator cylinder, two small rollers press the sheet against the applicator cylinder near to the ends of the sheet before the sheet receives the images so that the bridge of the applicator cylinder is in close contact with the ribbon and allows the adhesive on the images to be applied to be brought up to the desired temperature, and afterwards, the sheet passes over a press cylinder which is the same width as the sheet, this allowing the images to be applied to the paper.

Thus, the pressure exerted by the two rollers which, from the outset, ensures that the sheet is pressed firmly against the applicator cylinder, leaves undesirable marks on the sheet.

The object of the present invention is to propose a machine similar to the one described earlier, but which does not have the aforementioned disadvantages.

SUMMARY OF THE INVENTION

The machine according to the present invention is one which is fitted with a device for preheating the ribbon upstream of the applicator cylinder so as to preheat the images which will be applied to the sheet of paper by simple contact of said pads with the images against the press cylinder.

The advantage of this machine lies in the fact that the preheating of the images that are to be applied to the sheet makes it possible to avoid the obligation of using press rollers pressing against the two longitudinal edges of the sheet to ensure good contact with the applicator cylinder and obtain the desired heating. Furthermore, the fact that simple contact between the pads on the applicator cylinder and the impression cylinder is enough to transfer the images from the ribbon onto the paper makes it possible not to have to modify the machine when the formats of the notes or of the sheets change, it simply being necessary for the pads to be moved both in the axial and in the peripheral directions, to suit the new dimensions of the sheet and notes to be printed, the ribbon with the images to be applied being prepared with the spacings that correspond to the new dimensions.

According to one alternative embodiment, the machine is one wherein, with a view to economizing on ribbon, the machine is fitted with means which allow the ribbon to be made to advance in synchronism with the sheet passing between the applicator cylinder and the press cylinder, to slow down the advance of the ribbon and to make it back up over a distance equal to approximately the length of a sheet, when the sheet has left the applicator cylinder while waiting for the arrival of the next sheet and to bring the ribbon into register with the next sheet.

Thus, by means of this device, it is possible to economize on the length of ribbon which in other apparatuses continues to turn even between the end of one sheet and the arrival of the next, which sheets are always separated by at least a few centimeters. These means take advantage of this space between the end of one sheet and the start of the next to slow down the advance of the ribbon and make it back up and bring it into register with the next sheet.

The means used to obtain these results are a pair of advance rollers arranged downstream of the applicator cylinder causing the ribbon to advance, a pair of backing-up rollers arranged upstream of the preheating device making it possible to slow down the ribbon and make it back up, a device for reading register marks already printed on the ribbon and controlling the aforementioned rollers, and devices for assisting the rollers at the time of abrupt changes in speed, these devices being arranged upstream of the backing-up rollers, and downstream of the advance rollers, respectively.

Said devices for assisting the rollers are advantageously two negative pressure boxes into which the ribbon is sucked, this making it possible to create a certain amount of slack in the travel of the ribbon which slack can thus be used to damp out abrupt changes in speed, as will be described later.

According to another preferred alternative embodiment of the invention, the ribbon is guided by a set of turn rollers so that it passes at least a second time between the applicator cylinder and the press cylinder in a position that is offset in the axial direction of these cylinders, that is to say to apply images to a second column of the sheet.

According to another alternative form, the machine comprises at least one second ribbon, which makes it possible to apply the images to a third column, or even a fourth if the machine is also fitted with turn means for causing the second ribbon to pass through a second time. The second pass of the ribbon has the advantage of economizing on ribbon because instead of placing the images on the ribbon with a separation that corresponds to one length of a banknote, the images are arranged half a length apart, which means that when the ribbon passes bet ween the press cylinder and the applicator cylinder for the first time, it is, for example, the odd-numbered images which are applied to the sheet, and when the ribbon passes through for the second time, it is the even-numbered images which a reapplied. This then makes it possible to economize on the length of ribbon.

Finally, according to another alternative embodiment, if it is necessary to apply not point images but an entire strip to the notes, this can easily be achieved using the aforementioned apparatus by replacing the pads with annular segments the length of which is equal either to the length of the sheet or to the length of the notes if these strips are to be applied over a certain length of the notes.

According to another alternative embodiment, the pad of the applicator cylinder may also be heated to obtain better adhesion of the images to the sheets and reduce any temperature differences between the various images.

There is a choice of heating means: hot air or radiation or infrared. These means may be made up of two parallel plates, one of which is a heating plate located on the same side as the adhesive, while the other has the function of reflecting the heat of the first.

BRIEF DESCRIPTION OF THE DRAWING

The invention will be described in greater detail with the aid of the appended drawing in which.

DETAILED DESCRIPTION OF THE PREFERRED EMBODIMENTS

Figure 1:
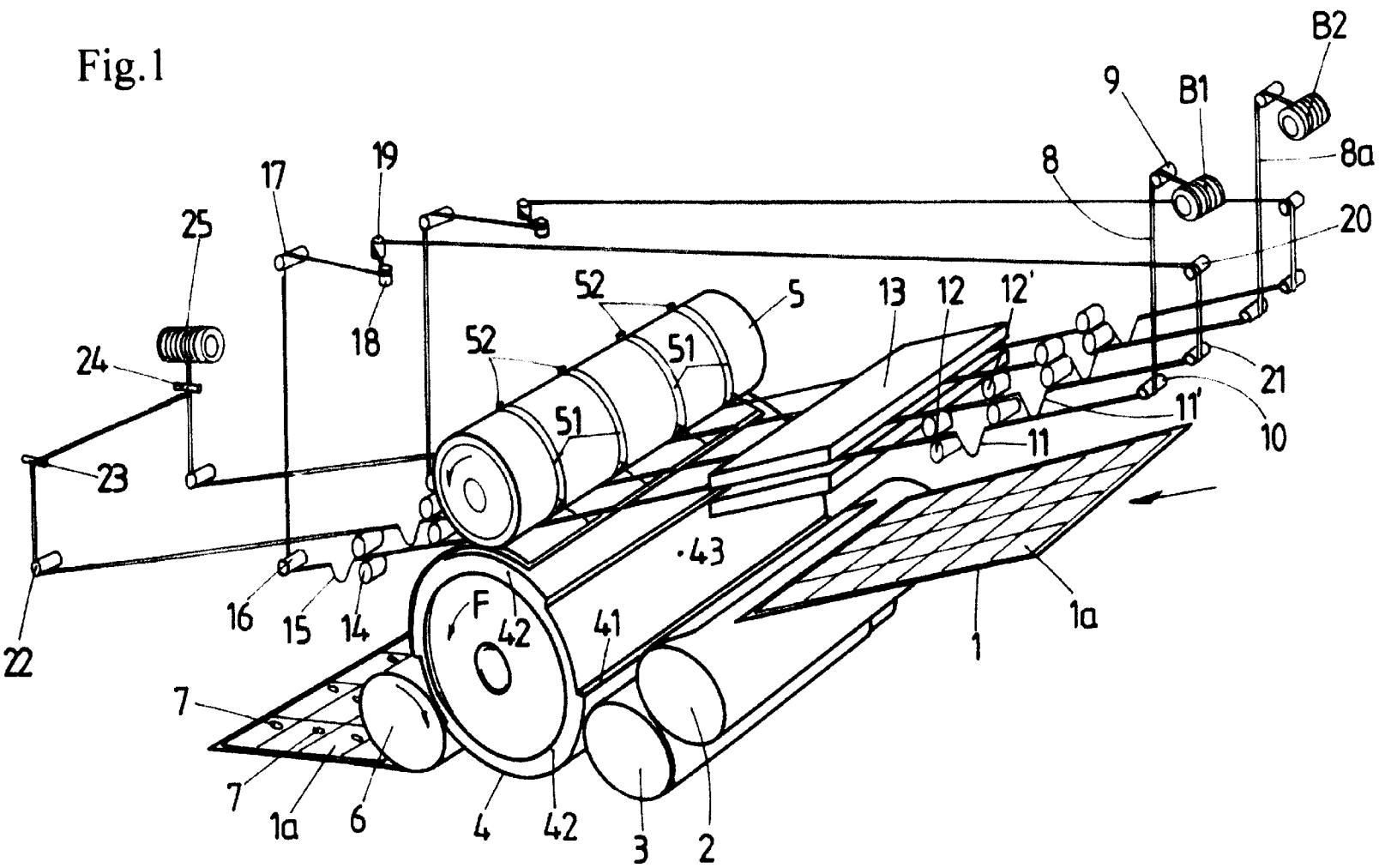
FIG. 1 shows a schematic view in perspective of a machine according to a preferred embodiment of the invention.

The machine in question (FIG. 1) comprises two transfer cylinders 2 and 3 receiving the partially or completed sheets 1 on which an image 7 from the ribbon 8 is to be stuck. The sheets 1 arrive via conventional means from a stock of sheets leaving a printing apparatus. The transfer cylinders 2, 3 may advantageously be suction cylinders. Following the two transfer cylinders 2 and 3 there is a press cylinder 4 intended to receive two sheets 1. A device 41 for grasping the front edge in the direction of travel of the sheet 1, allows the sheet to be grasped and carried in the direction of travel of the cylinder indicated by the arrow F. The cylinder 4 is therefore fitted with two projecting parts 42 separated by two grooves 43, one of the ends of which is fitted with means 41 for grasping the front edge of the sheet 1.

Above the impression cylinder 4 there is the applicator cylinder 5 fitted with rings 51 bearing the pads 52 for pressing the images 7 against the sheet 1.

A cylinder 6 which in theory is a suction cylinder, takes hold of the sheet 1 after the sheet has passed between the two cylinders 4 and 5 and transfers it to a storage device. Often, before storing the sheets 1 on which the security images 7 have been stuck, the sheets 1 pass through a cooling device to cool the adhesive.

In the apparatus of the present invention, use is made of two reels B1 and B2 each comprising a ribbon 8, 8*a* respectively, provided with the images 7 arranged along the length of these ribbons in such a way that said images, when the ribbon passes between the cylinders 4 and 5, are applied at the desired points.

We shall briefly describe the passage of the ribbon, it being understood that this apparatus is not the only apparatus possible. Starting from the reel B1, two turn rollers or rolls 9 and 10 allow the ribbon to be guided toward a suction device 11, the use of which will be explained later, followed by two backing-up rollers 12, before passing between the preheating device 13 and thereafter between the press cylinder 4 and the application cylinder 5. Next, it passes between the advance rollers 14, the second suction device 15 and, by means of turn rollers 16, 17, 18 and 19, the ribbon passes onto the upstream part of the apparatus to pass a second time, with the aid of the rollers 20 and 21, over a suction device 11' of the backing-up rolls 12', and the heating device 13 before passing once again between the press and applicator cylinders along a second column to finish up, having been turned at the turn rollers 22, 23, 24, on a winding-up reel 25. Likewise, starting from the reel B2, the ribbon 8*a*, via devices which are entirely similar, passes twice between the cylinders 4 and 5 before also being wound up onto the same reel 25. The double pass of the ribbon between the impression and applicator cylinders makes it possible to save on length of ribbon because instead of placing the images that are to be applied on the ribbon at a distance equal to the distance between two consecutive images 7 on the sheet 1, the images are arranged every half distance and as the first length of ribbon passes between the applicator and press cylinders, the, for example, odd-numbered images, are applied and, as the second length of ribbon passes, it is the even-numbered images which are applied. Thus, a saving of approximately half the length of the ribbon is made.

Obviously the spacing of the rings 51, and of the pads 52, depend on the size of the security papers 1 a printed on the sheet 1. If there is a change either in the format of the sheet or in the format of the security papers 1*a*, then either the applicator cylinder 5 can be changed, or quite simply rings 51 and the pads can be changed or moved so that the pads are perfectly in register with the points at which the images are to be applied.

Clearly the ribbons 8 and 8*a* used have spacings between the images that correspond to the format of the sheet 1 and the security papers 1*a* to be printed.

Figure 2:
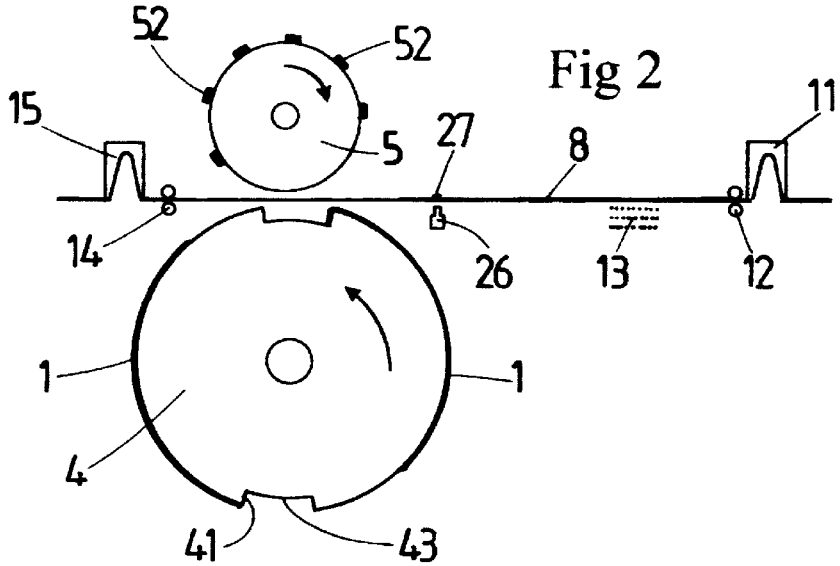
FIGS. 2 to 4 are a partial side view of the apparatus allowing the operation of the machine to be explained.
Figure 3:
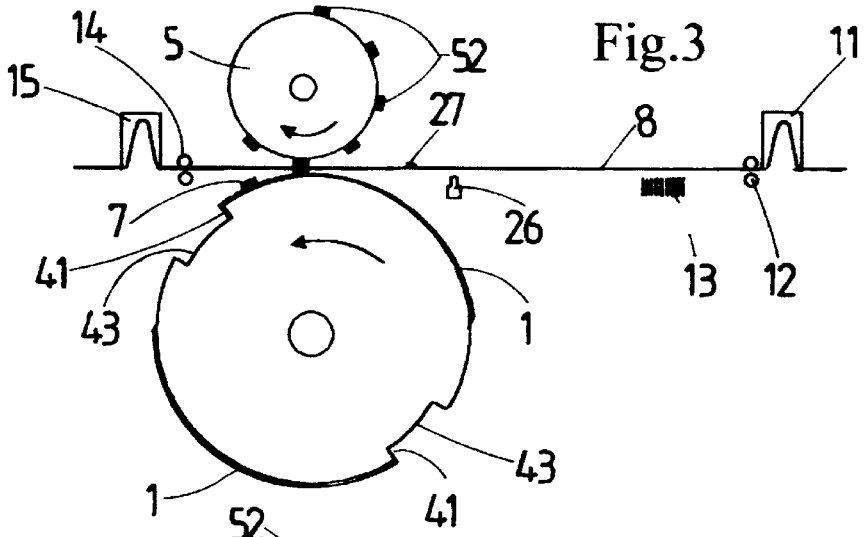
Figure 4:
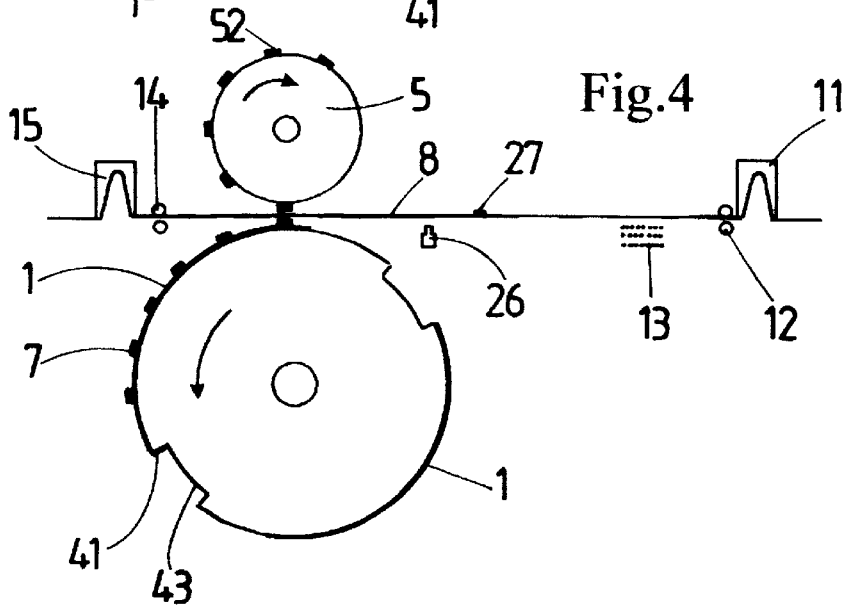

We shall now explain the operation of this machine with the aid of FIGS. 2 to 4.

To start with, the ribbon is brought into register with the sheet 1 onto which the images 7 are to be transferred. To do this, the ribbon has regular markings 27 which are read by a device 26 located after the heating device 13 and before the point where the ribbon comes into contact with the two, press 4 and applicator 5, cylinders. This device 26 has not been shown on the apparatus depicted in FIG. 1, in order not to make the drawing needlessly more complicated. The reader 26 allows the backing-up rollers 12 and advance rollers 14 to be controlled in such a way as to correctly position the ribbon 8.

The heating means 13 operate intermittently so as not to needlessly preheat the ribbon. One could even merely heat the images that are to be applied as the ribbon passes between the aforementioned cylinders. In the position indicated in FIG. 1, preheating 13 has stopped and the ribbon is also stopped, the register marking 27 lying facing the reader 26. As soon as the sheet of paper 1 approaches the line joining the two axes of the cylinders 4 and 5, the ribbon moves in synchronism with the sheet 1 and the images supported by the ribbon 8 are pressed against the sheet 1, using pads 52, as can be seen in FIG. 2. When the ribbon 8 starts to move, heating 13 is activated to heat the length of ribbon or the images on the ribbon which will follow. In this particular instance, it is the advance rollers 14 which draw the ribbon forward assisted by the device 15. When the last image 7 to be transferred onto the sheet 1 in question has been applied, heating is stopped, as too is the ribbon, by stopping the advance rollers 14 and actuating the backing-up rollers 12 assisted by the device 11, to tension the ribbon. While the press cylinder 4 and the applicator cylinder 5 continue to rotate to come into their starting position for applying images 7 to the second sheet 1 that is on the press cylinder 4, the ribbon 8 is backed up by approximately a length equal to the length of a sheet, repositioned by means of the rollers 12 and 14 under the control of the device 26 that reads the position 27 of the register marking. During this period, preheating 13 is stopped.

As soon as the position of the cylinder 5 means that the front edge of the next sheet 1 is aligned with the line of the axes of the two cylinders, the process explained above recommences. The two suction elements 11 and are intended to suck in part of the length of the ribbon 8 assisting the rollers 12 and 14 and in some way creating some slack which, on the one hand, should the ribbon accelerate abruptly, allows this acceleration to be absorbed without causing undesirable tension in the reel and, on the other hand, should there be any deceleration, making it possible also to absorb the difference in speed by sucking in the length of ribbon which continues to advance on account of inertia.

Figure 5:
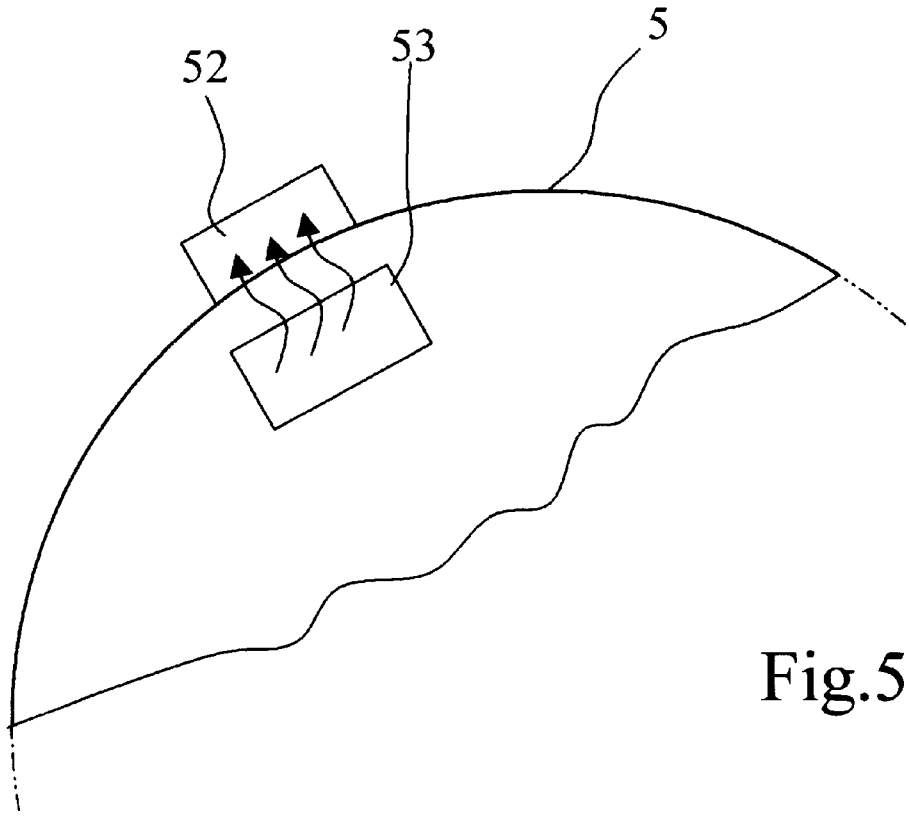
FIG. 5 is a schematic view of a heated pad on the application cylinder of the invention.

Now referring to FIG. 5 according to a preferred alternative form of the invention, the pads 52 may also be heated via a heat transmitter 53 so as to provide an almost constant temperature at which the images 7 are applied to the sheet 1.

Obviously, the steps described above relating to the ribbon 8 are also applicable to the second length of this ribbon 8 as well as to the ribbon 8*a* because the task of applying the images occurs along a generatrix of the applicator cylinder, namely applies to four security papers of a row of security papers printed on the sheet.

The size of the pads corresponds approximately to the size of the images to be applied. Temperature regulation is desirable so that the preheated images reach the point of application at the correct temperature. Depending on the adhesive used and on the working conditions, it is possible for the pads 52 not to be heated if the preheat temperature is high enough.

According to an alternative embodiment, the apparatus may also be used for applying not images but entire strips to the notes and in this case, instead of having pads as depicted here, we have pads which are annular segments allowing the strip to be applied directly either to the sheet from one end to the other or just to the notes, and in this case we need to have several separate annular sectors.

The heating means 13 are made up of two parallel plates, of which the one located on the same side as the adhesive is a heating plate, whereas the other reflects heat.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. An improved apparatus for use in security printing of security paper (1*a*), especially banknotes, comprising:

(a) a paper sheet;

(b) a device which transports the paper;

(c) an application unit for applying security images (7) which are supported on at least one ribbon (8, 8*a*), the ribbon being brought into contact with a sheet of paper (1), the images (7) being applied at predetermined points on the paper (1) corresponding to the printing on the security paper (1*a*), the application unit comprising two reels (B1, B2), a winding up reel (25), a preheating device (13), a press cylinder (4) and an applicator cylinder (5), the applicator cylinder (5) having pads (52) arranged on the periphery of the applicator cylinder in register with said predetermined points, cooperating with the press cylinder (4), between which cylinders a paper path is defined, said ribbon (8, 8*a*) being mounted between the two reels (B1, B2) which dispense and the winding up reel which winds up the ribbon, the ribbon (8, 8*a*) passing parallel to the path of the paper (1), and the preheating device (13) preheating the ribbon (8, 8*a*) and being mounted upstream of the applicator cylinder (5) so as to preheat the images (7) which will be applied to the sheet of paper (1) by simple contact of said pads (52) with the images (7) against the press cylinder.

2. The apparatus as claimed in claim 1, wherein, in order to economize the consumption of ribbon (8, 8*a*), the apparatus is fitted with synchronizing means which allow the ribbon (8, 8*a*) to be made to advance in synchronism with the sheet (1) passing between the applicator cylinder (5) and the press cylinder (4), to slow down the advance of the ribbon (8, 8*a*) and to make it back up over a distance equal to approximately the length of a sheet, when the sheet (1) has left the applicator cylinder (5) while waiting for the arrival of the next sheet and to bring the ribbon (8, 8*a*) into register with the next sheet.

3. The apparatus as claimed in claim 2, wherein said synchronizing means comprise a pair of advance rollers (14) arranged downstream of the applicator cylinder (5) causing the ribbon (8, 8*a*) to advance, a pair of backing-up toilers (12, 12') upstream of the preheating causing the ribbon (8, 8*a*) to back up, a device (26) for reading the register marks (27) with which the ribbon (8, 8*a*) is provided, and assistance means (11; 15) arranged upstream of the backing-up rollers (12, 12*a*) and downstream of the advance rollers (14) providing assistance to said rollers when the ribbon (8, 8*a*) experiences a change in speed.

4. The apparatus as claimed in claim 3, wherein said assistance means (11; 15) for assisting said rollers (12, 14) when there is a change in speed are two negative pressure boxes into which a section of ribbon (8, 8*a*) is drawn.

5. The apparatus as claimed in claim 4, wherein the ribbon (8, 8*a*) is guided by a set of turn rollers (16 to 21) so that it passes at least a second time between the applicator cylinder (5) and the press cylinder (4) in a position that is offset in the axial direction of these cylinders.

6. The apparatus as claimed in claim 1, which comprises at least a second ribbon (8*a*) for applying images (7) to a position that is axially offset with respect to the first ribbon (8).

7. The apparatus as claimed in claim 1, wherein the images are strips extending from one side of the security paper (1*a*) to the other, the pads of the applicator cylinder being annular segments the length of which corresponds to the length of the sheets (1) or of the security papers (1*a*).

8. The apparatus as claimed in claim 1, wherein the pads (52) of the applicator cylinder (5) are equipped with heating means.

9. The apparatus as claimed in claim 5, wherein the preheating device employs hot air, infra-red, or radiation.

10. The apparatus as claimed in claim 5, wherein said preheating device comprises two parallel plates, one of which, placed on the same side as the ribbon (8, 8*a*) emits heat, and the other of which, situated on the other side of the ribbon, is designed to reflect the heat emitted by the first plate.

* * * * *